US009266248B2

(12) United States Patent
Kraft

(10) Patent No.: US 9,266,248 B2
(45) Date of Patent: Feb. 23, 2016

(54) MULTIPLE TOOL

(71) Applicant: PASS Stanztechnik AG, Creussen (DE)

(72) Inventor: Stefan Kraft, Schnabelwaid (DE)

(73) Assignee: PASS STANZTECHNIK AG, Creussen (DE)

( * ) Notice: Subject to any disclaimer, the term of this patent is extended or adjusted under 35 U.S.C. 154(b) by 425 days.

(21) Appl. No.: 13/683,435

(22) Filed: Nov. 21, 2012

(65) Prior Publication Data

US 2013/0133497 A1 May 30, 2013

(30) Foreign Application Priority Data

Nov. 25, 2011 (DE) ..... 10 2011 087 084

(51) Int. Cl.

| | |
|---|---|
| ***B26D 7/00*** | (2006.01) |
| ***B21D 28/00*** | (2006.01) |
| ***B21D 28/36*** | (2006.01) |
| ***B21D 28/12*** | (2006.01) |

(52) U.S. Cl.

CPC ..... *B26D 7/00* (2013.01); *B21D 28/002* (2013.01); *B21D 28/125* (2013.01); *B21D 28/36* (2013.01); *Y10T 83/8759* (2015.04)

(58) Field of Classification Search

CPC .... B21D 22/08; B21D 28/125; B21D 28/346; B21D 28/12

USPC ..... 83/684, 34, 552, 571, 640, 50, 549, 83/563, 556, 559, 618, 641; 72/446, 441, 72/482.93; 234/94–119; 483/28, 29

See application file for complete search history.

(56) References Cited

U.S. PATENT DOCUMENTS

| | | | | | |
|---|---|---|---|---|---|
| 4,440,052 | A | * | 4/1984 | Weisbeck | 83/140 |
| 5,048,385 | A | | 9/1991 | Eckert et al. | |
| 5,577,312 | A | * | 11/1996 | Seto | 29/418 |
| 5,848,563 | A | * | 12/1998 | Saito | 83/552 |
| 6,047,621 | A | * | 4/2000 | Dries et al. | 83/136 |
| 6,074,330 | A | * | 6/2000 | Ostini | 483/29 |

FOREIGN PATENT DOCUMENTS

| | | |
|---|---|---|
| EP | 1759783 A1 | 3/2007 |
| WO | 0132330 A1 | 5/2001 |

* cited by examiner

*Primary Examiner* — Ghassem Alie

(74) *Attorney, Agent, or Firm* — Browdy and Neimark, PLLC

(57) ABSTRACT

A multiple tool is provided for a punching device. The multiple tool includes a driving mechanism, displaceable in a punching direction, with a driving head for driving the driving mechanism by the punching device and a driving body connected to the driving head. The multiple tool further includes a punching tool magazine, which is connected to the driving mechanism, with a guide body, and a plurality of punching tools guided in the guide body. The punching tools in each case have an effective punching length for punching a workpiece to be machined. The driving body cooperates in each case, during punching use, with one of the punching tools to drive it. The multiple tool also includes a mechanical punching length testing mechanism to test the effective punching length of the punching tools.

18 Claims, 5 Drawing Sheets

MULTIPLE TOOL

CROSS-REFERENCES TO RELATED APPLICATIONS

This application claims the priority of German Patent Application, Serial No. 10 2011 087 084.9, filed Nov. 25, 2011, pursuant to 35 U.S.C. 119(a)-(d), the content of which is incorporated herein by reference in its entirety as if fully set forth herein.

FIELD OF THE INVENTION

The invention relates to a multiple tool for a punching device, in particular for a turret punch press.

BACKGROUND OF THE INVENTION

Multiple tools or multiple punching tools, also called multi-tools, are generally known for punching devices from the prior art. The multiple tools have a plurality of punching tools, which gradually wear during the punching use. The punching tools can generally be ground to a certain extent at their punching part, in order to be able to continue to use them.

SUMMARY OF THE INVENTION

The invention is based on the object of providing a multiple tool for a punching device, which is particularly user-friendly and maintenance-friendly.

This object is achieved according to the invention by a multiple tool for a punching device, in particular for a turret punch press, comprising a) a driving mechanism, which can be displaced in a punching direction, the driving mechanism having
   i) a driving head for driving the driving mechanism by means of the punching device, and
   ii) a driving body connected to the driving head,
b) a punching tool magazine, which is connected to the driving mechanism, the punching tool magazine having
   i) a guide body, and
   ii) a plurality of punching tools guided in the guide body, wherein the punching tools in each case have an effective punching length for punching a workpiece to be machined, and
   wherein the driving body, during punching use, in each case cooperates with one of the punching tools to drive it, and
c) a mechanical punching length testing mechanism to test the effective punching length of the punching tools.

The core of the invention is that the multiple tool has a mechanical punching length test mechanism. The effective punching length of the punching tools can easily and quickly be tested using the punching length test mechanism. Further, separate aids are thus unnecessary for this check. The effective punching length is taken to mean the punching length here, which is required for punching the workpiece to be machined. The effective punching length is preferably slightly larger than the thickness of the workpiece to be machined.

Preferably between 3 and 24 punching tools are guided in the guide body. Corresponding guides, which can be configured as guide recesses, are provided in the guide body to guide the punching tools. The punching tools are advantageously configured differently.

The test spring element, in which the punching length testing mechanism has at least one test spring element, wherein a displacement of the punching tool to be tested in the punching direction to test this punching tool leads to an actuation of the test spring element and the test spring element in the actuated state exerts a restoring force on the punching tool to be tested, is preferably configured as a helical spring. However, it may also, for example be configured as a plate spring, resilient material block or the like. The test spring element can preferably be actuated indirectly by the punching tool to be tested. However, it can also be actuated directly by the punching tool to be tested. By actuating the test spring element, its length changes and the test spring element produces a spring force or restoring force, which acts on the punching tool to be tested and moves it back into its rest position. The test spring element may be configured as a test spring pressure element or a test spring pulling element. In a configuration as a test spring pushing element, the test spring element is compressed during testing use and it produces a compressive force acting on the punching tool to be tested.

It is advantageous if precisely one test spring element is provided, which is arranged on the longitudinal center axis of the multiple tool. However, several test spring elements may also be provided, which are connected in parallel or in series.

The configuration, in which the test spring element can be manually actuated by finger pressure, allows a simple and uncomplicated actuation of the test spring element or the punching tool to be tested. The finger pressure is taken to mean a pressure, which can be applied, for example, by a user of a machine or operator of a machine with at least one of his fingers on the test spring element.

A preferred characteristic of the test spring element is the test spring element having a spring rate, which is between 0.1 N/mm and 5 N/mm, preferably between 0.2 N/mm and 1.0 N/mm.

According to another preferred characteristic, the test spring element has a length, which can be varied by 3 mm to 40 mm, preferably by 5 mm to 15 mm. It is advantageous if the length of the spring test element can be manually compressed by 3 mm to 40 mm, more preferably by 5 mm to 15 mm, by the finger pressure.

The base element, in which the test spring element can be compressed in the punching direction relative to a base element, which is provided on the guide body and has at least one through-opening for the punching tools, is preferably configured as a separate component, which is fastened to the guide body. The arrangement in which the punching length test mechanism is arranged in the punching tool magazine, is simple and functionally reliable.

The configuration, in which each punching tool has a fixed, laterally projecting movement transmission projection, the punching length test mechanism preferably having a center part, which can be displaced by the movement transmission projection of the punching tool to be tested in the punching direction and actuates the test spring element during testing use, allows a reliable transmission of the movement of the punching tool or the force applied thereto by way of the center part to the test spring element. The movement transmission projection is preferably configured as a web, preferably as an annular web, which projects laterally relative to the punching tool body, at least in regions. The center part is connected, preferably directly, to the punching tool to be tested. Furthermore, the center part acts during testing use on the test spring element. The displacement of the punching tool to be tested is thus transmitted to the center part, so that this is also displaced. The center part is arranged and configured in such a way that it can be actuated by the various punching tools to be tested during testing use.

The punching tool fixing element being comprised by the punching tool magazine to fix the punching tools located in an inner rest position, the punching tool fixing element preferably having at least one test opening, allows a local fixing of the punching tool located in the rest position. During testing use, only an actuation of the corresponding punching tool provided for the punching process preferably takes place. Furthermore, the punching tool fixing element, during testing use, advantageously fixes the punching tools, which are not currently being tested.

The test opening, during testing use, preferably being arranged adjacent to the punching tool to be tested in the punching direction, allows a simple, manual displacement of the punching tool to be tested.

The gripping projection, comprised by the punching tool fixing element for engaging on the punching tools located in an inner rest position, is preferably a gripping web, which is provided on the punching tool fixing element and holds the punching tools in their rest position. The gripping projection preferably then grips underneath the movement transmission projection of the corresponding punching tools. It is advantageous if the gripping web is circular ring-like.

The multiple tool, in which the driving mechanism and the punching tool magazine can be separated from one another, the punching length testing mechanism being actuable when the driving mechanism and the punching tool magazine are separated from one another substantially has two main components. These are releasably connected to one another by a corresponding connecting mechanism. The driving mechanism and the punching tool magazine are preferably screwed together.

It is expedient if at least one pretensioning spring element acting on the punching tool magazine is arranged in the driving mechanism, the at least one pretensioning spring element having a pretensioning force of a total of at least 100 N. All the pretensioning spring elements together preferably have a pretensioning force, which is between 100 N and 10,000 N. The total spring rate of all the pretensioning spring elements added together is preferably between 200 N/mm and 4,000 N/mm. The pretensioning spring elements are preferably configured as helical springs. Other pretensioning spring elements, such as plate springs or material blocks, can alternatively be used. The punching tools are extremely well guided in the guide body owing to the arrangement of the at least one pretensioning spring element in the driving mechanism. The at least one pretensioning spring element is arranged outside the punching tool magazine.

Thicker workpieces, such as metal sheets, can also be machined without problems owing to the advantageous guide ratios, in which a coupling piece carrying a center part is seated on the at least one test spring element, a connecting bushing resting on the driving head transmitting a punching force during punching onto the center part for the axial movement thereof, the connecting bushing and the center part being guided over a total guide length and the punching tool guides having longitudinal center axes located on a diameter, a guide ratio of the total guide length to the diameter of 1.5 to 2.5, more preferably of 1.7 to 2.2, being present between the total guide length and the diameter, and in which provided in the guide body are a plurality of punching tool guides, which in each case have a punching tool guide length and a punching tool guide transverse dimension, each punching tool having a punching tool body, which is axially displaceable, while guided in the respective punching tool guide, a guide ratio of the punching tool guide length to the punching tool guide transverse dimension of 2.2 to 4.2, more preferably of 2.8 to 3.2 being present. Machinable metal sheets may have a thickness up to 8 mm.

A preferred embodiment of the invention will be described by way of example below with reference to the accompanying drawings.

DESCRIPTION OF THE PREFERRED EMBODIMENT

Figure 1:
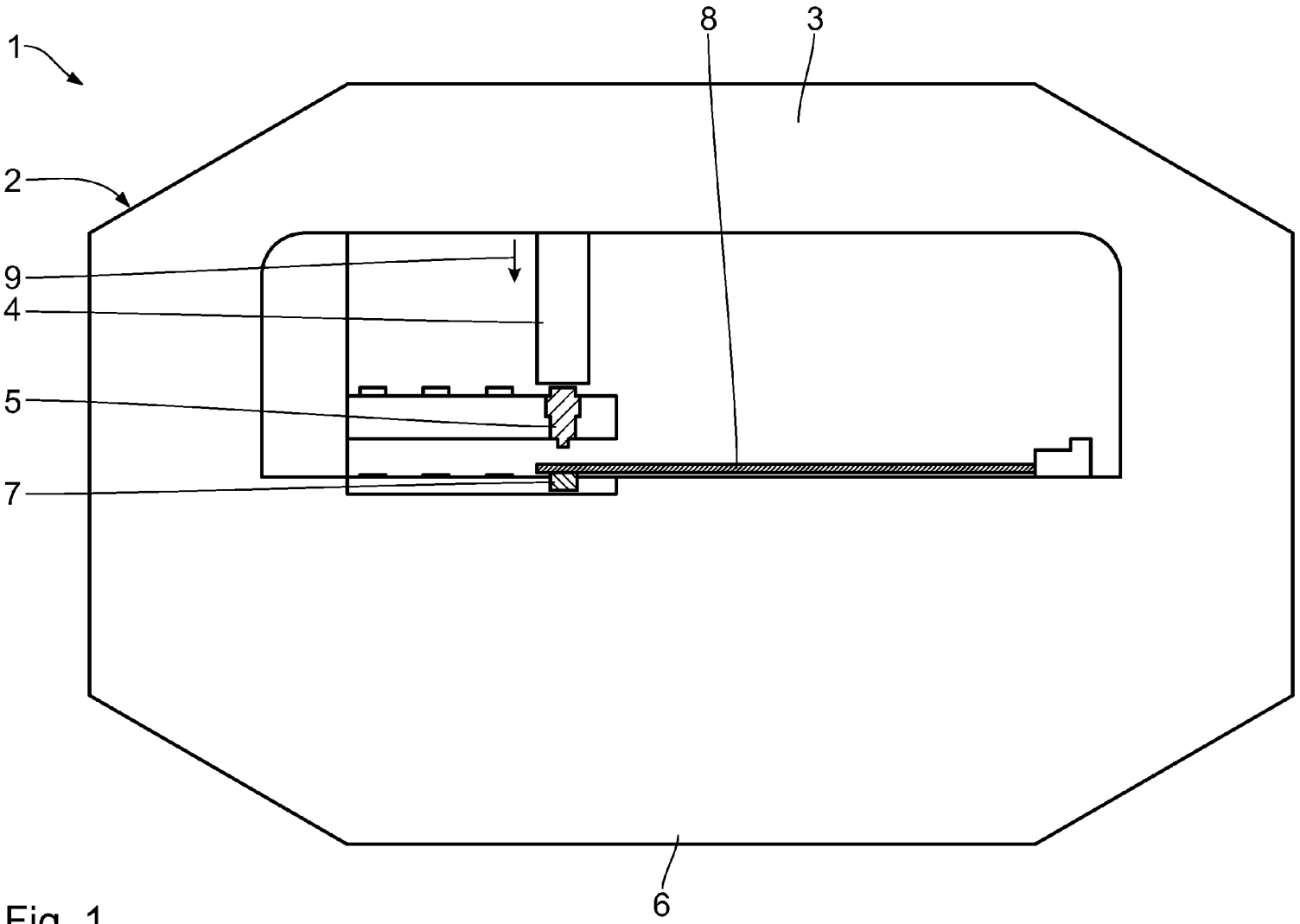
FIG. 1 shows a side view of a schematically shown punching device with a multiple tool according to the invention.

A punching device 1 shown in its entirety in FIG. 1 comprises a frame 2, on the upper frame part 3 of which is attached an actuating ram 4. Under the actuating ram 4, a multiple tool 5 is typically arranged in a turret. A die 7 is located on the lower frame part 6 of the frame 2. Located between the multiple tool 5 and the die 7 is a workpiece 8 to be machined, which is a metal sheet here. During punching use, in other words during punching, a punching tool of the multiple tool 5 is pushed downward by the activating ram 4 through the workpiece 8 into the die 7. As a result, an opening is formed in the workpiece 8 by the punching tool. The punching tool, in the process, is moved in a punching direction 9 in the direction of the die 7 or the workpiece 8. According to FIG. 1, the punching direction 9 is directed vertically downward.

Figure 2:
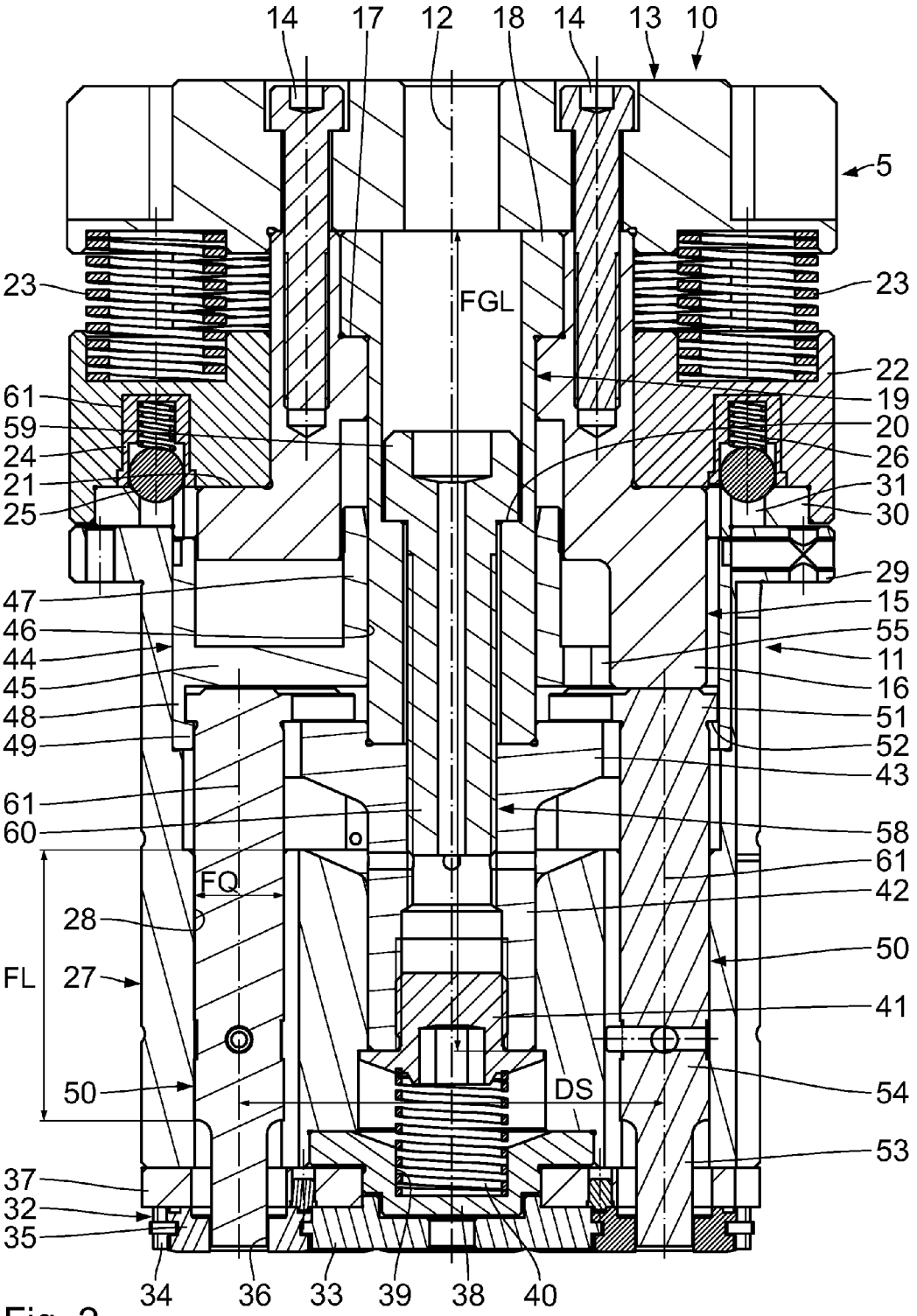
FIG. 2 shows a longitudinal section through the multiple tool according to the invention shown in a simplified manner in FIG. 1, the punching tools of which are in a rest position.
Figure 3:
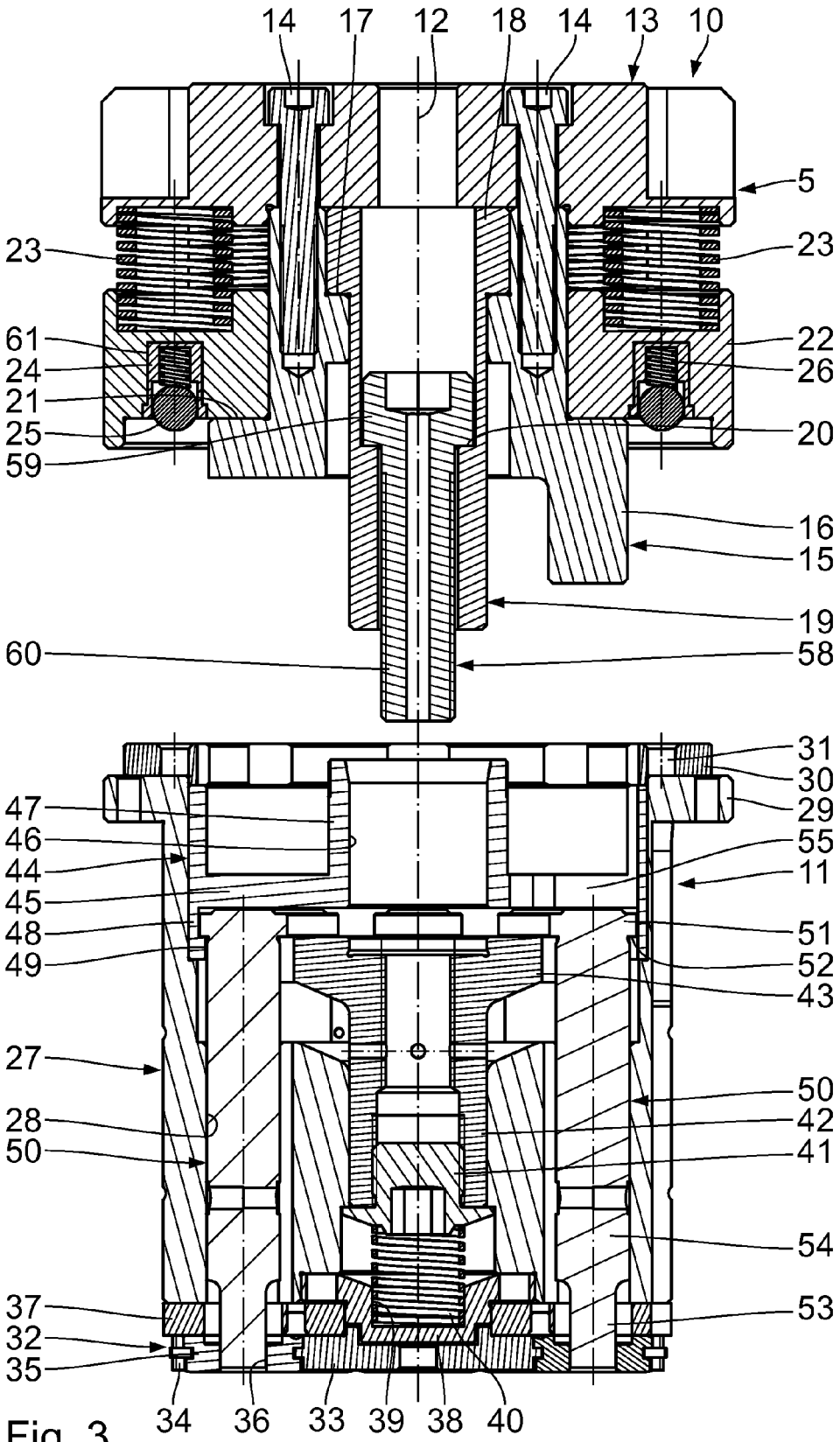
FIG. 3 shows a sectional view similar to FIG. 2, the driving mechanism and the punching tool magazine being separated from one another.
Figure 4:
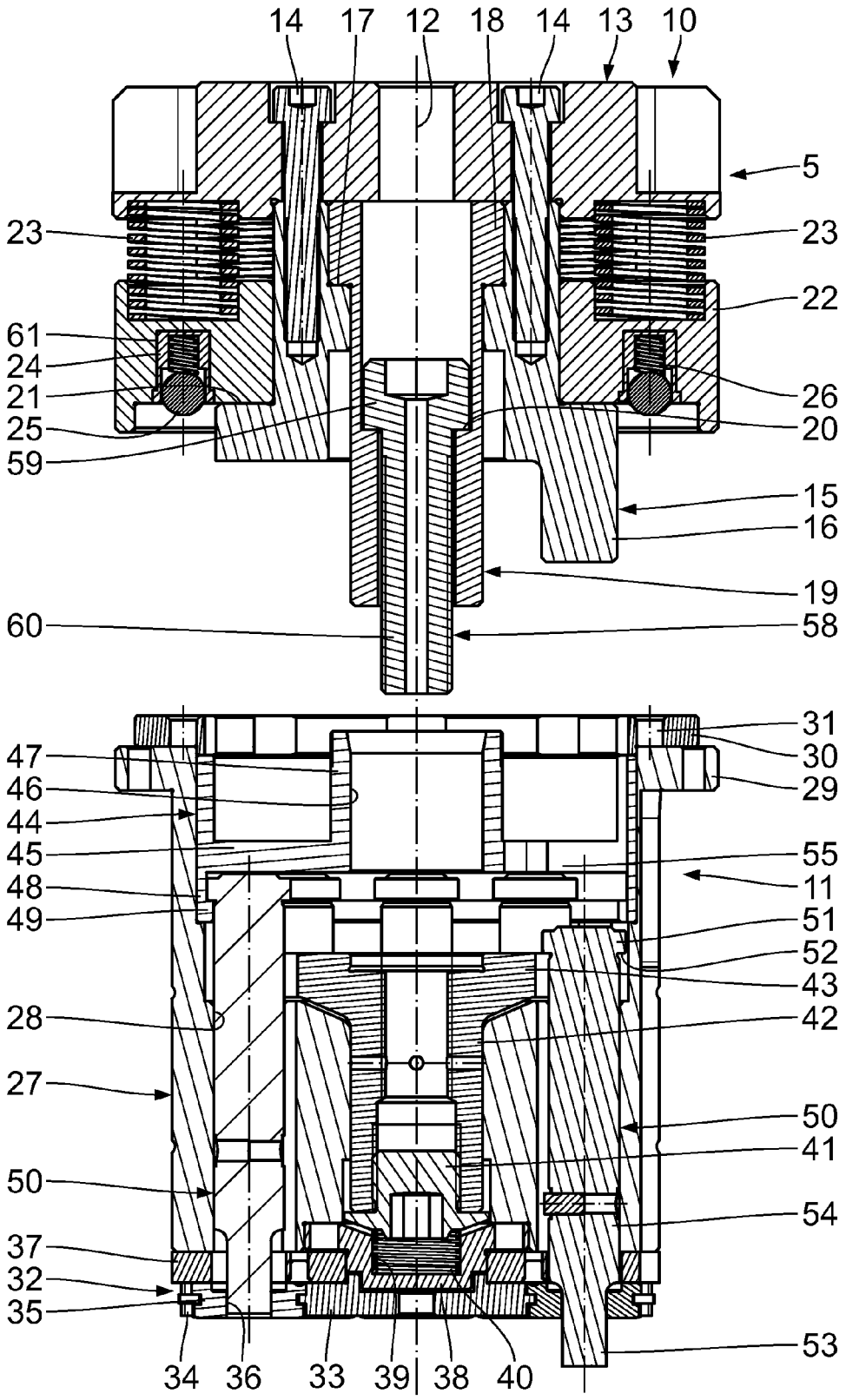
FIG. 4 shows a sectional view similar to FIG. 3, a punching tool being in its test position.

Referring to FIGS. 2 to 4, the multiple tool 5 comprises an upper driving mechanism 10 and a lower punching tool magazine 11, which have a common longitudinal center axis 12. The driving mechanism 10 and the punching tool magazine 11 are combined during punching use. They are then releasably connected to one another.

The driving mechanism 10 in turn has a driving head 13, on which a driving bolt body 15 is attached by means of a plurality of fastening screws 14. The driving bolt body 15 comprises a driving bolt 16 projecting away from the driving head 13. The driving bolt 16 is arranged eccentrically with respect to the longitudinal center axis 12.

The driving bolt body 15 has a holding shoulder 17 facing the driving head 13. A head 18 of a connecting bushing 19 rests on the holding shoulder 17, said connecting bushing also resting on the driving head 13 and thus being fixed to the driving head 13. The connecting bushing 19 extends along the center longitudinal axis 12 and in turn has an inner abutment shoulder 20, which faces the driving head 13.

The driving bolt body 15 also has an outer fixing shoulder 21, which also faces the driving head 13. A stop ring 22, which runs around the driving bolt body 15, rests on the fixing shoulder 21. A plurality of prestressing springs 23 are seated in the stop ring 22. The prestressing springs 23 are identical and preferably have the same spacing with respect to one another. The prestressing springs 23 are supported at the bottom on the driving head 13 and on the base side on the stop ring 22. A plurality of recesses 61, which are open toward the punching tool magazine 11, are configured in the stop ring 22. A pressure piece bushing 24 is seated in each recess 61. Displaceably guided in turn in each pressure piece bushing 24 is a spherical pressure piece 25, which projects relative to the pressure piece bushing 24 and the stop ring 22 in the direction of the punching tool magazine 11 and is pressed by a compression spring 26 in the direction of the punching tool magazine 11. The stop ring 22 is movable in the direction of the driving head 13. Upon a movement of the stop ring 22 in the direction of the driving head 13, the prestressing springs 23 are compressed and exert a corresponding restoring force on the stop ring 22 with the pressure pieces 25.

The punching tool magazine 11 has a sleeve-like guide body 27, in which a plurality of punching tool guides 28 are provided. The guides 28 have an identical spacing from one another and are arranged around a center longitudinal axis 12. They extend in parallel with respect to the longitudinal center axis 12. The guides 28 are open in each case at the end.

The guide body 27 has a connecting flange 29, which is arranged adjacent to the driving mechanism 10 when the multiple tool 5 is assembled. A lock 30 with a plurality of locking recesses 31 is provided on the connecting flange 29. The locking recesses 31 are associated with the pressure pieces 25 and have a corresponding complementary cross sectional shape.

A stripping mechanism 32, which forms a base element and substantially closes the guide body 27 there, is arranged opposing the driving mechanism 10 on the guide body 27. The stripping mechanism 32 comprises a plate-shaped central holding body 33, in which a plurality of receiving recesses 34 are configured. The receiving recesses 34 are arranged adjacent to the guides 28. A disc-like stripping element 35 is inserted in each receiving recess 34 and in turn has a central through-opening 36. Furthermore, the stripping mechanism 32 has an intermediate plate 37, which is located between the holding body 33 and the guide body 27 and fixes the holding body 33 on the guide body 27.

A cup-shaped receiving body 38, which has a central receiving recess 39, is seated on the holding body 33 on the inside in the guide body 27. The receiving recess 39 is cylindrical and extends along the longitudinal center axis 12. The receiving body 38 is inserted centrally into the intermediate plate 37.

A test spring 40, which projects from the receiving recess 39 on the side remote from the holding body 33, is seated in the receiving recess 39. The test spring 40 is configured as a helical compression spring, which can be manually compressed by a finger pressure in the punching direction 9.

A coupling piece 41, which carries a center part 42, is seated on the end of the test spring 40 remote from the receiving body 38. The center part 42 is configured in the manner of a bushing and has the longitudinal center axis 12 passing through it axially. The center part 42 has a center part head 43 extending laterally outwardly, which opposes the receiving body 38.

Figure 6:
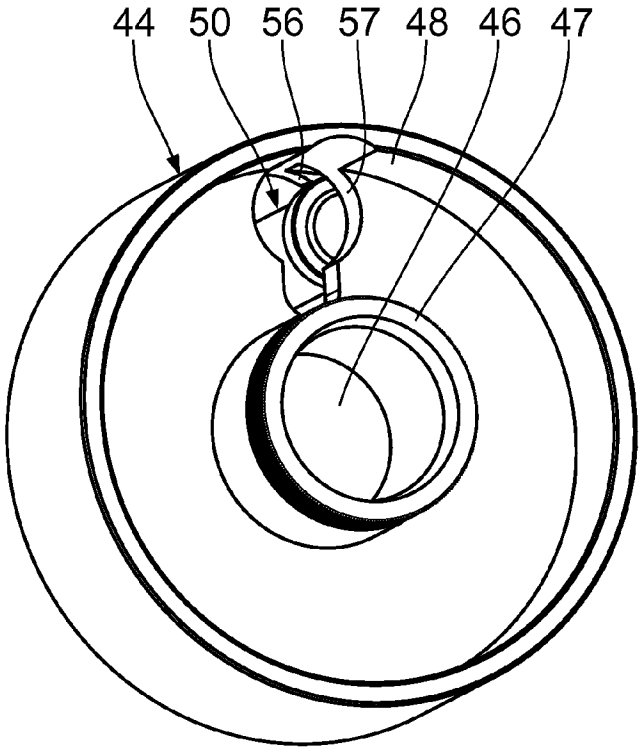
FIG. 6 shows a perspective view, which shows the punching tool fixing element shown in FIG. 5 obliquely from above.
Figure 5:
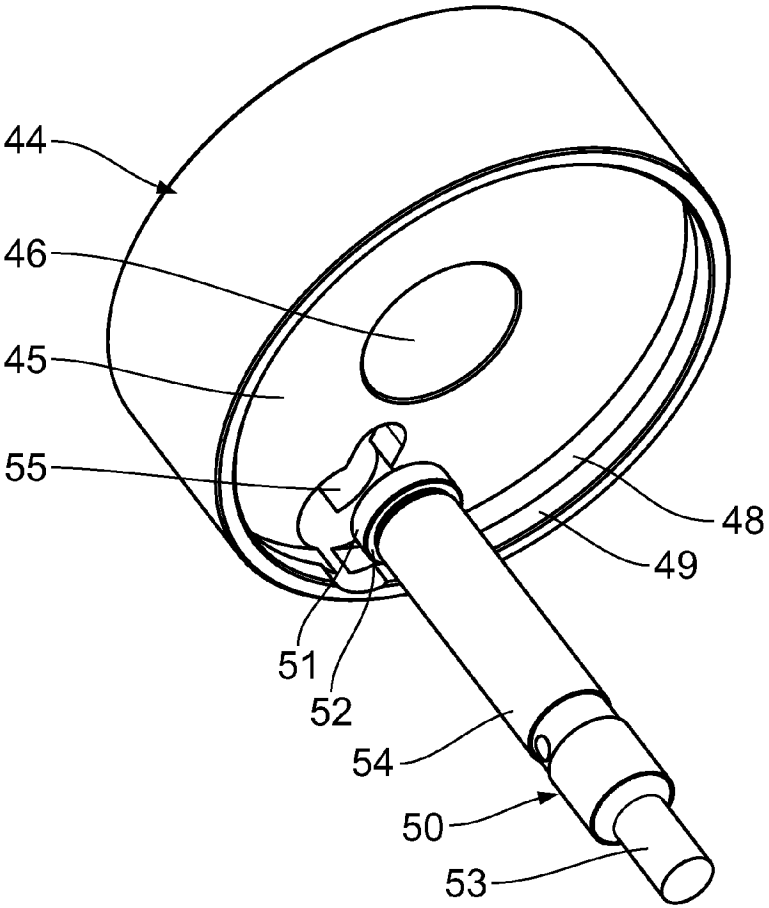
FIG. 5 shows a perspective view from below, which shows a punching tool and a punching tool fixing element.

A punching tool fixing element 44, which is also shown separately in FIGS. 5 and 6, is inserted in the guide body 27. The punching tool fixing element 44 extends from the connecting flange 29 in the direction of the stripping mechanism 32. However, it ends spaced apart from the stripping mechanism 32. The punching tool fixing element 44 has a base plate 45, which extends perpendicular to the longitudinal center axis 12 and has a central opening 46 passing through it. An annular web 47 projects from the base plate 45 in the direction of the driving mechanism 10. The annular web 47 runs around the opening 46. A side wall 48 adjoins the base plate 45 on the outside. The side wall 48 projects from the base plate 45 both in the direction of the stripping mechanism 32 and in the direction of the locking ring 30. Provided on the side wall 48 in the region projecting to the stripping mechanism 32 is a gripping web 49, which projects there from the side wall 48 perpendicularly inwardly in the direction of the longitudinal center axis 12. The gripping web 49 is arranged spaced apart from the base plate 45.

A test opening 55, which is arranged eccentrically with respect to the longitudinal center axis 12 and thus laterally with respect to the opening 46, is furthermore provided in the base plate 45. The test opening 55 has two mutually opposing opening positions 56, 57. The gripping web 49 is recessed in the region of the test opening 55.

A punching tool 50 is arranged in each guide 28. Each punching tool 50 is elongate and substantially cylindrical. Each punching tool 50 has a punching tool body 54, on which a punching tool head 51 facing the driving mechanism 10 is provided. The punching tool heads 51, in comparison to the punching tool bodies 54, have a larger transverse dimension, so that, in each case, a movement transmission face 52 facing the stripping mechanism 32 is formed. The punching tool heads 51 thus form movement transmission projections.

Each punching tool 50 furthermore has a punching tool part 53, which is provided opposing its punching tool head 51 on the punching tool body 54 and is tapered relative to the punching tool body 54. The punching tool part 53 substantially determines the effective punching length of the respective punching tool 50. The punching tools 50 preferably differ with respect to their punching tool parts 53. The transverse dimensions of the punching tool parts 53 substantially correspond to the respective through-openings 36. The punching tools 50 are axially displaceably guided in and counter to the punching direction 9 in the guides 28.

The multiple tool 5 will be described in detail below in its assembled state for punching use.

A connecting screw 58 passing through the connecting bushing 19 is used to rigidly connect the driving mechanism 10 and the punching tool magazine 11, the screw head 59 of said connecting screw resting on the abutment shoulder 20. The connecting screw 58 has an elongate shaft 60 with an external thread, which is screwed into the center part 42. The connecting bushing 19 passes through the opening 46 and rests on the annular web 47 on the inside.

The pressure pieces 25 engage in a latching manner in the locking recesses 31 of the locking ring 30, so that a relative pivoting movement about the longitudinal center axis 12 is prevented between the driving mechanism 10 and the punching tool magazine 11. The pressure pieces 25 are pressed by the prestressing springs 23 and the compression springs 26 into the locking recesses 31.

The driving bolt 16 passes through the test opening 55 and is arranged adjacent to the punching tool head 51 of the punching tool 50 to be actuated.

The remaining punching tools 50 are fixed by the punching tool fixing element 44. The gripping web 49 in this case grips under the respective punching tool heads 51, so that the punching tool heads 51 rest on the gripping web 49. These punching tools 50 are then located in their inner rest position, in which they are arranged completely in the guide body 27 and do not project out of the punching tool magazine 11.

During punching use, the driving head 13 is pushed by the actuating ram 4, so the driving bolt 16 is also axially displaced in the punching direction 9. This punching force is in this case transmitted from the punching head 13 onto the connecting bushing 19, which transmits the punching force with its head 18 via the holding shoulder 17 onto the driving bolt body 15 comprising the driving bolt 16. The punching tool 50 aligning with the driving bolt 16 is then axially displaced in the punching direction 9 in its guide 28 by the driving bolt 16. The driving bolt 16 passes through the test opening 55 in the process. The punching tool part 53 of the displaced punching tool 50 in this case passes through the through-opening 36 and passes through the workpiece 8 into the die 7. The connecting bushing 19 also transmits the punching force centrally onto the center part 42 for the axial movement thereof. The central force transmission prevents a tilting of the center part 42.

The connecting bushing 19 also transmits, together with the connecting screw 58 after the punching, to the center part 42, a stripping force, which is produced by the rebounding prestressing springs 23.

A different punching tool 50 can be locally displaced by the driving bolt 16 by a relative pivoting movement between the driving mechanism 10 and the punching tool magazine 11 about the longitudinal center axis 12. The pressure pieces 25 hold the driving head 13 in a desired pivoting position. They then engage in a latching manner in the locking recesses 31. The connecting bushing 19 also allows a pivoting movement of the driving mechanism 10 and the punching tool magazine 11 about the longitudinal center axis 12. The head 18 of the connecting bushing 19 is namely received with play in the driving mechanism 10.

The test use of the multiple tool 5, in other words the testing of at least one punching tool 50, will be described in more detail below. For this purpose, the driving mechanism 10 and the punching tool magazine 11 are separated from one another by releasing the connecting screw 58. The test opening 55 is oriented according to the punching tool 50 to be tested. A machine operator or a tester exerts a finger pressure directed onto the stripping element 32 via the test opening 55 on the punching tool head 51 of the punching tool 50 to be tested in such a way that the punching tool 50 to be tested is axially displaced in the punching direction 9. The punching tool 50 to be tested is in this case located, like the other punching tools 50, in the punching tool magazine 11.

As the center part 42 rests with its center part head 43 on the movement transmission face 52 of the punching tool head 51, the center part 42 is also displaced axially in the punching direction 9 along the center longitudinal axis 12 by the described coupling between the punching tool 50 to be tested and the center part 42. The coupling piece 41 rigidly connected to the center part 42 and preferably having a screw connection is correspondingly also moved. In this case, the test spring 40 is compressed in the punching direction 9. The test spring 40 is supported relative to the stripping mechanism 32, which is fastened to the guide body 27. The punching tool part 53 of the punching tool 50 to be tested passes through the through-opening 36 of the associated stripping element 35 and then projects at the bottom from the through-opening 36. It is advantageous if the punching tool part 53 then projects by about 10 mm from the through-opening 36 at the bottom. The effective punching length of the punching tool 50 to be tested can then be tested or measured. The punching tool 50 to be tested is then in its disengaged test position (FIG. 4). The compressed test spring 40 then pushes the tested punching tool 50 back into its rest position when the finger pressure is no longer exerted to an adequate extent, or not at all.

The punching tool fixing element 44 prevents the remaining punching tools 50 also being moved when testing one punching tool 50.

The connecting bushing 19 and the center part 42 are axially displaceably guided in the driving mechanism 10 or in the punching tool magazine 11 over a total guide length FGL. Each punching tool guide 28 has a longitudinal center axis 61. The longitudinal center axes 61 of the punching tool guides 28 are located on a diameter DS, the center of which is in turn on the center longitudinal axis 12 of the multiple tool 5.

The diameter DS thus runs around the longitudinal center axis 12 of the multiple tool 5. A guide ratio of the total guide length FGL to the diameter DS of 1.5 to 2.5, preferably of 1.7 to 2.2, is present between the total guide length FGL and the diameter DS.

Each punching tool 50 can be axially displaced while guided with its punching tool body 54 in the respective punching tool guide 28. Each punching tool guide 28 has a punching tool guide length FL and a punching tool guide transverse dimension FQ. A guide ratio of punching tool guide length FL to punching tool guide transverse dimension FQ of 2.2 to 4.2, preferably of 2.8 to 3.2, is present, in each case.

Details of the described embodiment may also, taken individually, be an invention or be part of a subject of the invention. This relates, in particular, to the punching tool fixing element 44 for fixing the punching tool 50 located in a rest position.

A corresponding multiple tool 5 for a punching device 1 then comprises a driving mechanism 10, which can be displaced in the punching direction 9, with a driving head 13 to drive the driving mechanism 10 by the punching device 1 and a driving body 16 connected to the driving head 13. The multiple tool 5 then also has a punching tool magazine 11, which is connected to the driving mechanism 10, with a guide body 27 and a plurality of punching tools 50 guided in the guide body 27. The punching tools 50 in each case have an effective punching length for punching a workpiece 8 to be machined, the punching body 16 cooperating in each case during punching use with one of the punching tools 50 to drive it. Furthermore, the multiple tool 5 then has the punching tool fixing element 44 to fix the punching tools 50 located in a rest position. The punching tool fixing element 44 preferably has a gripping projection 49, which, to fix the punching tools 50 to be fixed, engages therein.

What is claimed is:

1. A multiple tool for a punching device (1), comprising a) a driving mechanism (10), which can be displaced in a punching direction (9), the driving mechanism (10) having i) a driving head (13) for driving the driving mechanism (10) by means of the punching device (1), and ii) a driving body (16) connected to the driving head (13), b) a punching tool magazine (11), which is connected to the driving mechanism (10), the punching tool magazine (11) having i) a guide body (27), and ii) a plurality of punching tools (50) guided in the guide body (27), wherein the punching tools (50) in each case have an effective punching length for punching a workpiece (8) to be machined, and wherein the driving body (16), during punching use, in each case cooperates with one of the punching tools (50) to drive the one of the punching tools, and c) a mechanical punching length testing mechanism to test the effective punching length of the punching tools (50), wherein the punching length testing mechanism has at least one test spring element (40), which is disposed and configured such that a displacement of the punching tool (50) in the punching direction (9) when the punching tool (50) is tested leads to an actuation of the test spring element (40), and the test spring element (40) in the actuated state exerts a restoring force on the punching tool (50) being tested, wherein the test spring element (40) can be manually actuated by finger pressure, wherein the test spring element (40) has a spring rate, which is between 0.1 N/mm and 5 N/mm, wherein the test spring element (40) can be compressed in the punching direction (9) relative to a base element (32), which is provided on the guide body (27) and has at least one through-opening (36) for the punching tools (50), and wherein the finger pressure directed onto the base element (32) is exertable by a machine operator or tester via a test opening (55) on a punching tool head (51) of the punching tool (50) to be tested so that the punching tool (50) to be tested is axially displaced in the punching direction (9).

2. The multiple tool according to claim 1 for a turret punch press.

3. A multiple tool according to claim 1, wherein the test spring element (40) has a spring rate, which is between 0.2 N/mm and 1.0 N/mm.

4. A multiple tool according to claim 1, wherein the test spring element (40) has a length, which is variable by 3 mm to 40 mm.

5. A multiple tool according to claim 1, wherein the test spring element (40) has a length, which is variable by 5 mm to 15 mm.

6. A multiple tool according to claim 1, wherein the punching length test mechanism is arranged in the punching tool magazine (11).

7. A multiple tool according to claim 1, wherein each punching tool (50) has a fixed, laterally projecting movement transmission projection (51).

8. A multiple tool according to claim 1, wherein the punching length test mechanism has a center part (42), which can be displaced by the movement transmission projection (51) of the punching tool (50) to be tested in the punching direction (9) and actuates the test spring element (40) during testing use.

9. A multiple tool according to claim 1, wherein the punching tool magazine (11) comprises a punching tool fixing element (44) to fix the punching tools (50) located in an inner rest position.

10. A multiple tool according to claim 9, wherein the punching tool fixing element (44) has at least one test opening (55), the test opening (55), during testing use, being arranged adjacent to the punching tool (50) to be tested in the punching direction (9).

11. A multiple tool according to claim 9, wherein the punching tool fixing element (44) has a gripping projection (49) for engaging on the punching tools (50) located in an inner rest position.

12. A multiple tool according to claim 1, wherein the driving mechanism (10) and the punching tool magazine (11) can be separated from one another, the punching length testing mechanism being actuable when the driving mechanism (10) and the punching tool magazine (11) are separated from one another.

13. A multiple tool according to claim 1, wherein at least one pretensioning spring element (23) acting on the punching tool magazine (11) is arranged in the driving mechanism (10), the at least one pretensioning spring element (23) having a pretensioning force of a total of at least 100 N.

14. A multiple tool according to claim 1, wherein during testing use, the punching tool (50) to be tested passes through the associated through-opening (36) and projects from the through-opening (36) at the bottom, so the effective punching length of the punching tool (50) to be tested can be tested.

15. A multiple tool according to claim 1, wherein a coupling piece (41) carrying a center part (42) is seated on the at least one test spring element (40), a connecting bushing (19) resting on the driving head (13) transmitting a punching force during punching onto the center part (42) for the axial movement thereof, the connecting bushing (19) and the center part (42) being guided over a total guide length (FGL) and the punching tool guides (28) having longitudinal center axes (61) located on a diameter (DS), a guide ratio of the total guide length (FGL) to the diameter (DS) of 1.5 to 2.5 being present between the total guide length (FGL) and the diameter (DS).

16. A multiple tool according to claim 15, wherein a guide ratio of the total guide length (FGL) to the diameter (DS) of 1.7 to 2.2 is present between the total guide length (FGL) and the diameter (DS).

17. A multiple tool according to claim 1, wherein provided in the guide body (27) are a plurality of punching tool guides (28), which in each case have a punching tool guide length (FL) and a punching tool guide transverse dimension (FQ), each punching tool (50) having a punching tool body (54), which is axially displaceable, while guided in the respective punching tool guide (28), a guide ratio of the punching tool guide length (FL) to the punching tool guide transverse dimension (FQ) of 2.2 to 4.2.

18. A multiple tool according to claim 17, wherein a guide ratio of the punching tool guide length (FL) to the punching tool guide transverse dimension (FQ) of 2.8 to 3.2 is present.

* * * * *